US006751873B2

(12) United States Patent
Mattson et al.

(10) Patent No.: US 6,751,873 B2
(45) Date of Patent: Jun. 22, 2004

(54) FOLDABLE EATING UTENSIL

(75) Inventors: Larry J. Mattson, Charlotte, NC (US); David B. Dupes, York, SC (US)

(73) Assignee: Roberts PolyPro, Inc., Charlotte, NC (US)

( * ) Notice: Subject to any disclaimer, the term of this patent is extended or adjusted under 35 U.S.C. 154(b) by 145 days.

(21) Appl. No.: 09/927,997

(22) Filed: Aug. 10, 2001

(65) Prior Publication Data

US 2003/0029044 A1 Feb. 13, 2003

(51) Int. Cl.[7] ..... A47J 43/28
(52) U.S. Cl. ..... 30/324; 30/322
(58) Field of Search ..... 30/322, 324

(56) References Cited

U.S. PATENT DOCUMENTS

| | | | | | |
|---|---|---|---|---|---|
| 1,288,617 | A | * | 12/1918 | Kupiszewski | 30/324 |
| 2,812,577 | A | * | 11/1957 | Leibow | 30/324 |
| 4,060,176 | A | | 11/1977 | Tobiasson | |
| 4,393,988 | A | | 7/1983 | Burke | |
| 4,615,120 | A | | 10/1986 | Newman | |
| 4,826,033 | A | | 5/1989 | Satoh | |
| 4,984,367 | A | | 1/1991 | Albanese | |
| 5,058,279 | A | | 10/1991 | Mars | |
| 5,060,386 | A | | 10/1991 | Mars | |
| 5,419,049 | A | | 5/1995 | MacArthur-Onslow | |
| 5,592,744 | A | | 1/1997 | Weinstein | |
| 5,630,276 | A | | 5/1997 | Weinstein | |
| 5,699,618 | A | | 12/1997 | Barbera | |
| D388,664 | S | | 1/1998 | Gagnon et al. | |
| 5,705,212 | A | * | 1/1998 | Atkinson | 426/115 |
| 5,735,050 | A | * | 4/1998 | Hsieh | 30/324 |
| 5,940,974 | A | * | 8/1999 | Lee | 30/324 |
| D414,988 | S | | 10/1999 | Santini | |
| 5,992,667 | A | * | 11/1999 | Huang | 220/212 |
| 6,068,114 | A | | 5/2000 | Zimmerman et al. | |

* cited by examiner

*Primary Examiner*—Allan N. Shoap
*Assistant Examiner*—Isaac N Hamilton
(74) *Attorney, Agent, or Firm*—John B. Hardaway, III; Nexsen Pruett, LLC

(57) ABSTRACT

A one piece foldable eating utensil having a food holding section and a handle with a pair of reduced thickness portions forming flexible hinges for folding into a packaged position for accompanying a food product and a useable position for consuming the food product.

5 Claims, 2 Drawing Sheets

FOLDABLE EATING UTENSIL

TECHNICAL FIELD

This invention relates to an eating utensil and more particularly to a utensil adapted to accompany retail food products for use in consumption thereof

BACKGROUND OF THE INVENTION

An example of a foldable eating utensil is shown in U.S. Pat. No. 4,615,120 issued to Brett E. Newman on Oct. 7, 1986 for a Collapsible Spoon. The collapsible spoon of that patent may be made of plastic material and has a foldable handle with a single hinge joint. The handle is releaseably retained in a non-folded eating position by a releasable interlock. Further interlocking parts are provided for retaining the handle parts in alignment when the handle is folded back on itself.

Another example of a folding eating utensil is shown in U.S. Pat. No. 4,826,033 issued to Kou Satoh on May 2, 1989 for a Folding Food Take-Out Device. The food take-out device includes a handle having parts that fold about axes transverse to the handle and parts that fold about axes parallel to the elongated dimension of the handle. Ribbed projections are used to retain the handle sections in their adjusted positions.

OBJECTS AND SUMMARY OF THE INVENTION

It is a primary object of this invention to provide an eating utensil to accompany a retail food product. It is another object of this invention to provide a foldable eating utensil, which is economical to manufacture. It is a further and more particular object of this invention to provide an improved one piece plastic eating utensil with a food holding section and a handle permitting adjustment between folded positions to permit packaging in one position and use for food consumption in the other.

These as well as other objects are provided by a foldable eating utensil, which includes a handle having a pair of flexible hinges permitting the handle to be folded about a first hinge to a compact storage position in which a substantial part of the handle is in juxtaposed relation to the food holding section or folded back on itself about a second hinge to an eating position. In a third position the handle is not folded and extends in an aligned manner from the food holding section. The handle is detented in the storage and eating positions.

BRIEF DESCRIPTION OF THE DRAWINGS

One embodiment of the invention is illustrated in the accompanying drawings in which.

DETAILED DESCRIPTION

In accordance with this invention, it has been found that an eating utensil may be provided for accompanying the sale of retail food products for the consumption thereof more conveniently than was heretofore possible. The utensil of this invention may be collapsed or compacted for accompanying the food product and extended to a useful position for use in eating the food product. Various other advantages and features will become apparent from the following detailed description given with reference to the drawings.

Figure 1:
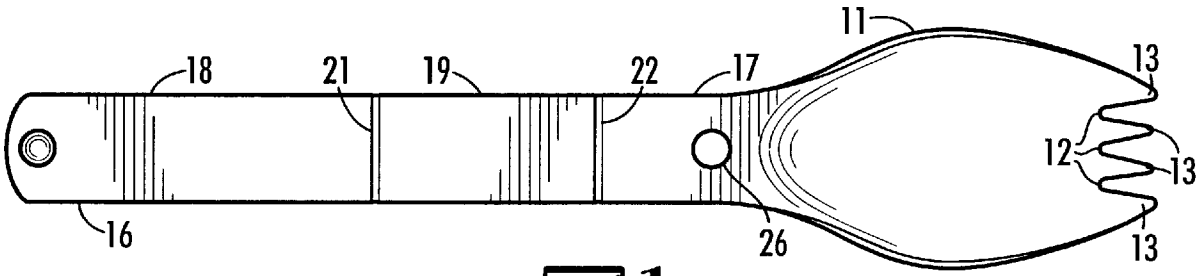
FIG. 1 is a top view of the eating utensil in an extended position.
Figure 2:
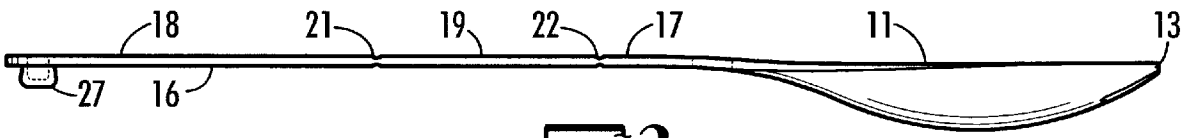
FIG. 2 is a side view of the utensil shown in FIG. 1.

As illustrated in FIGS. 1 and 2, the eating utensil includes a food holding or handling section 11 which may resemble either a spoon or a fork or both, called a spork, as illustrated here. The food holding section 11 includes three gaps 12 forming four teeth 13 at its free end which increase the utility of the utensil. The eating utensil also includes an elongated handle 16 having a proximal end 17 extending from the food holding section 11, a distal end 18 at its free end and an intermediate portion 19. The handle sections 17, 18, 19 are connected in series by a pair of flexible hinges 21, 22 which permit articulation or folding about a pair of axes which are transverse to the direction of elongation of the handle. Creases or scores in the handle 16, which reduce the thickness of the handle, form the hinges 21, 23. A gap or annular opening 26 is formed in the proximal portion 17 of the handle 16; the gap 26 serving as a detent for a knob or protrusion 27 formed on the underside of the free end of the distal end 18 of the handle 16 when the handle is folded back on itself to the eating position shown in FIGS. 4 and 5. The protrusion 27 has a ball-like shape and is hollow, allowing it to resiliently deform when it is snapped into the gap 26.

Figure 3:
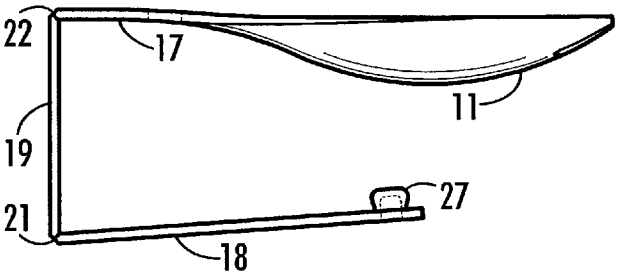
FIG. 3 is a side view showing the eating utensil articulated about its flexible hinges.

FIG. 3 shows the handle sections 17, 18, 19 in a semi-folded relation to one another. This view simply shows how the parts can articulate about the hinges 21, 22 in the handle 16.

Figure 4:
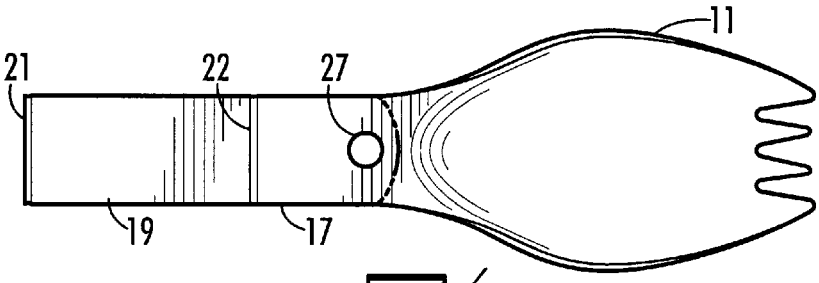
FIG. 4 is a top view of the utensil with its the handle folded to a position making the utensil suitable for use in eating food.
Figure 5:
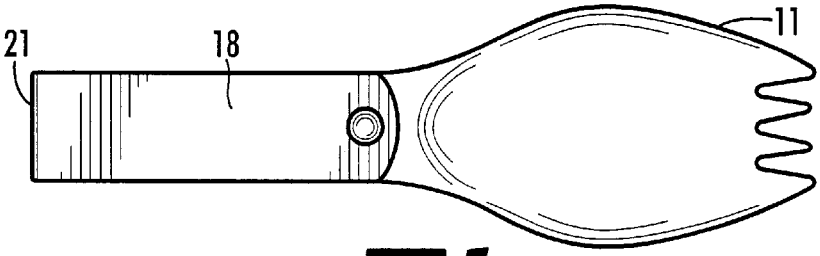
FIG. 5 is a bottom view of the utensil adjusted as shown in FIG. 4.

Referring to FIG. 4, the distal end 18 of the handle 16 has been folded about the flexible hinge 21 to an eating position of adjustment in which the utensil is convenient for eating. In this folded back position of the handle 16, the protrusion 27 on the distal end 18 of the handle 16 is snapped into the detent or gap 26 in the proximal section 17 to releasably detent the handle in its eating position of adjustment. As shown in FIG. 5, the distal end 18 forms a relatively rigid beam on the underside of the handle 16 and any tendency of the handle 16 to bend about the flexible hinge 22 is resisted by the snap lock connection and by the hand of the user gripping the handle 16.

Figure 6:
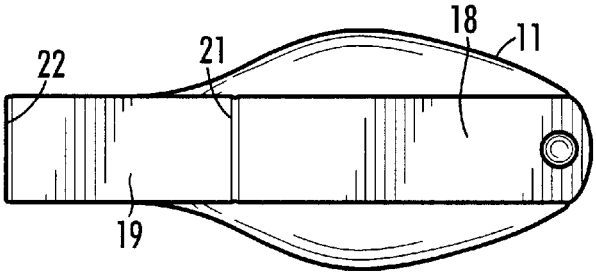
FIG. 6 is a top view of the utensil folded to a compact storage position.
Figure 7:
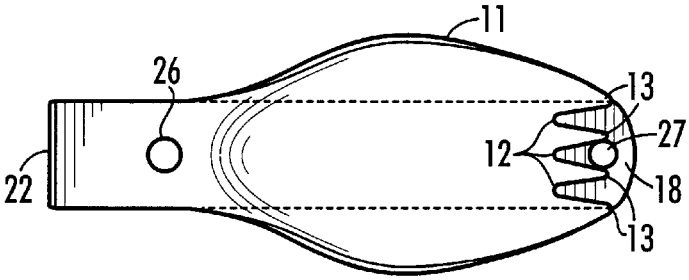
FIG. 7 is a bottom view of the utensil adjusted as shown in FIG. 6.

Referring to FIGS. 6 and 7, the eating utensil is shown with its handle 16 folded about the flexible hinge 22 to a compact storage position in which the protrusion 27 on the distal end 18 releasably engages a detent in the form of the middle gap 12 between the two central teeth 13 on the food holding section 11. The resiliency of the handle 16 and its hinges 21, 22 biases the protrusion 27 into the middle gap 12. When snapped into this compact storage position of adjustment, the distal end 18 of the handle 16 overlays or is coextensive with the food holding section 11. The utensil of this invention may be formed by conventional processes, such as injection molding or cold forming.

The illustrated and described one-piece foldable eating utensil is very economical to manufacture, thus permitting it to be packaged with ready to eat food products. The compact storage position of adjustment makes it an ideal utensil for packaging on the top of food containers, where it is readily accessible to the purchaser. The compact size and the protective position of the end of the handle, make this foldable eating utensil particularly suitable for shrink-wrapped packages. The releasable detents operate as snap locks, which makes adjustment of the handle very convenient.

As variations of this invention will become apparent to those in the art from the above description, which is exemplary in nature; such variations are within the scope of this invention as defined by the following claims.

What is claimed is:

1. A one piece, foldable eating utensil having a relatively long length direction and a relatively narrow width direction as compared to said length direction;

a food holding section at one end of said length direction;

a handle extending in said length direction from said food holding section, said handle being adjustable along said length direction between a first position wherein said handle is folded in a juxtapose relationship to said food holding section in which said eating utensil is in a compact storage position, a second position in which said handle is fully extended along said length direction, and a third position intermediate said first and second positions wherein said handle is folded back on itself along said length direction to an eating position;

said handle having flexible hinges therein transverse to said length direction and extending generally in said width direction to permit folding said handle along said length direction into said first, second and third position and including a locking means for locking said handle in said first and third position.

2. The utensil according to claim 1 wherein said eating utensil is made of plastic material and said flexible hinges are reduced thickness portions of said handle.

3. The eating utensil according to claim 1 wherein said handle has a proximal end adjacent said food holding section, a distal end and an intermediate portion between and connected to said proximate and distal ends by flexible hinges, said distal end including a protrusion and said food holding section and said proximal end each having a detent engageable with said protrusion.

4. The eating utensil according to claim 3 wherein said detents are gaps.

5. The eating utensil according to claim 3 wherein said detents cooperate with said protrusion to form a snap lock.

* * * * *